US008083062B2

(12) United States Patent
Norman

(10) Patent No.: US 8,083,062 B2
(45) Date of Patent: Dec. 27, 2011

(54) CARDHOLDER FOR GIFT CARD

(75) Inventor: Kevin S. Norman, Huron, OH (US)

(73) Assignee: Sandusky Packaging Corporation, Sandusky, OH (US)

( * ) Notice: Subject to any disclaimer, the term of this patent is extended or adjusted under 35 U.S.C. 154(b) by 0 days.

(21) Appl. No.: 12/180,852

(22) Filed: Jul. 28, 2008

(65) Prior Publication Data

US 2009/0266724 A1 Oct. 29, 2009

Related U.S. Application Data

(60) Provisional application No. 61/048,388, filed on Apr. 28, 2008.

(51) Int. Cl.
*A45C 11/18* (2006.01)

(52) U.S. Cl. ..... 206/454; 206/307; 206/39

(58) Field of Classification Search ..... 206/232, 206/449, 555, 454, 39, 307
See application file for complete search history.

(56) References Cited

U.S. PATENT DOCUMENTS

| | | | | |
|---|---|---|---|---|
| 5,595,401 | A | 1/1997 | Exline et al. | |
| 5,800,659 | A | 9/1998 | Exline et al. | |
| 5,913,539 | A | 6/1999 | Exline et al. | |
| 6,089,608 | A | 7/2000 | Exline | |
| 6,110,551 | A | 8/2000 | Exline et al. | |
| 6,120,228 | A | 9/2000 | Exline | |
| 6,634,493 | B2 | 10/2003 | Exline | |
| 6,796,424 | B2 | 9/2004 | Exline | |
| 7,044,293 | B2 | 5/2006 | Exline | |
| 2002/0130512 | A1 * | 9/2002 | Garrett | 283/116 |
| 2006/0198560 | A1 * | 9/2006 | Petit et al. | 383/35 |

OTHER PUBLICATIONS

SIMONgiftcard® holder specimen, www.simongiftcard.com, photographs.

* cited by examiner

*Primary Examiner* — Jacob K Ackun
(74) *Attorney, Agent, or Firm* — Pearne & Gordon LLP

(57) ABSTRACT

A cardholder for a card such as a gift debit card comprising an envelope and a folded-up sheet containing terms and conditions, the sheet being attached to the envelope, the envelope having a pocket adapted to receive and hold said card.

13 Claims, 6 Drawing Sheets

CARDHOLDER FOR GIFT CARD

CROSS-REFERENCE TO RELATED APPLICATIONS

This application claims the benefit of U.S. Provisional Application No. 60/048,388, filed Apr. 28, 2008, the entire disclosure of which is incorporated herein by reference.

FIELD OF THE INVENTION

The present invention relates generally to a cardholder, and more particularly, to cardholder for a card such as a debit card.

BACKGROUND OF THE INVENTION

Generally, shopping malls sell gift cards, in the form of debit cards, in various amounts, such as $10, $25, $50, to customers. To purchase such a gift card, the customer can go to the mall, pay the amount to be credited to the card plus a service fee (e.g., $2) and the mall credits the purchased amount (e.g., $25) onto the gift card. The mall then stuffs the gift card into a cardholder or carrier and hands the cardholder to the customer. The customer can then give the cardholder, holding the gift debit card, to another person as a gift. The recipient of the gift debit card can spend the money credited on the debit card just like an ordinary debit card, i.e., anywhere debit cards of that issuer are accepted.

Presently, when the mall provides the credited debit card to the customer, they place it in a cardholder which includes the terms and conditions which apply to the debit card. For example, a debit card cardholder is one made of cardboard-like paper and has the terms and conditions printed on both sides, filling up all of one side and half of the other side. On the front side of the cardholder, at the top, is a separate sleeve which holds the debit card. The remaining portion of the front side is filled with mostly a statement of the terms and conditions which control and govern the use of the card and the legal agreement between the issuer of the card, such as the mall, and the customer, usually referred to as cardholder agreement. On the back side of the cardholder are the terms and conditions which could not be fitted on the front side. Because the terms and conditions language is lengthy, the cardholder has to be folded up like an accordion or highway map until it forms a convenient package that can fit into the pocket or wallet of the consumer. On a busy day at a mall when dozens of these gift debit cards are being sold, it is too slow and difficult to get these long cardboard holders folded up correctly and given to customers. The folding also creates usability concerns for the consumer because it is difficult to refold the cardholder in the proper way once it is unfolded.

In another example, a cardholder has a front cover and a back cover. The inside of the front cover forms a sleeve for holding a gift card such as a gift debit card. This product is stitched down the middle like a book such that pages are included in the cardholder. This cardholder is costly and time consuming to make because of the need for multiple sheets, one for the cover and one for the pages. The stitching is also labor intensive.

It is believed that the terms and conditions should be physically attached to the sleeve holding the debit card to comply with legal requirements. In other words, it is believed that, in order to make sure that the terms and conditions are binding on the customer, the issuer makes sure that the terms and conditions are physically attached to the sleeve holding the debit card. Accordingly, there is a need for a cardholder that is easy and inexpensive to make and conveniently provides the terms and conditions of the cardholder agreement.

BRIEF SUMMARY OF THE INVENTION

A cardholder comprising an envelope for holding a card and a sheet containing terms and conditions, wherein the sheet is attached to an inside surface of the envelope.

A cardholder comprising an envelope, a front cover and a sheet containing terms and conditions. The envelope has an opening for receiving a card, the front cover is a single flap that covers the opening of the envelope, and the sheet containing terms and conditions is associated with the card held in the envelope.

DESCRIPTION OF EXAMPLE EMBODIMENTS

Embodiments described herein are shown with respect to FIGS. 1-6. Dimensions are in inches unless otherwise indicated. Also, in the following description, it is to be understood that such terms as "interior," "exterior," "front," "back" and the like are words of convenience used to describe the embodiments herein, and are not to be construed as limiting terms.

Figure 1:
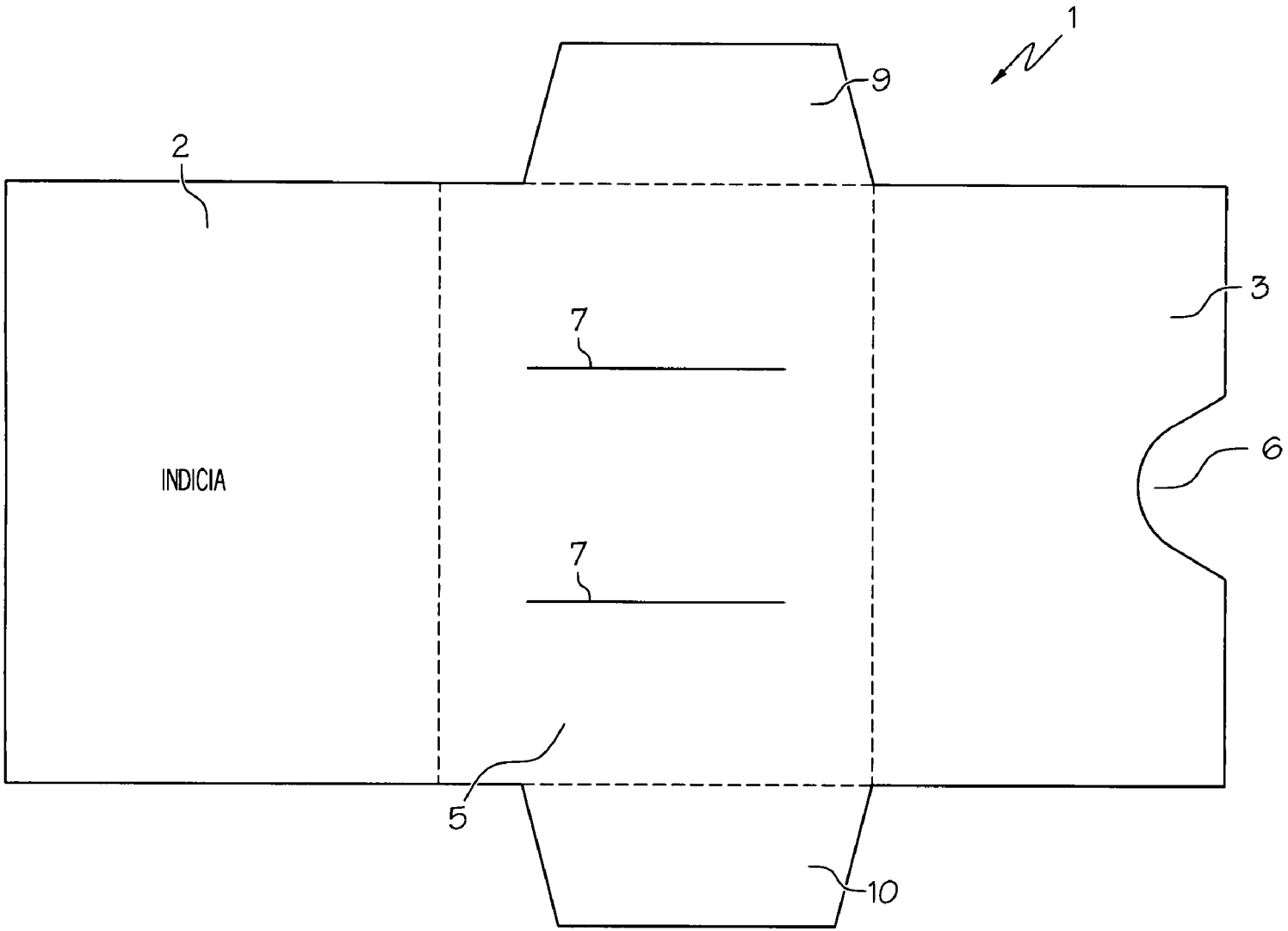
FIG. 1 is an interior view of an unfolded cardholder blank used for forming a cardholder.
Figure 2:
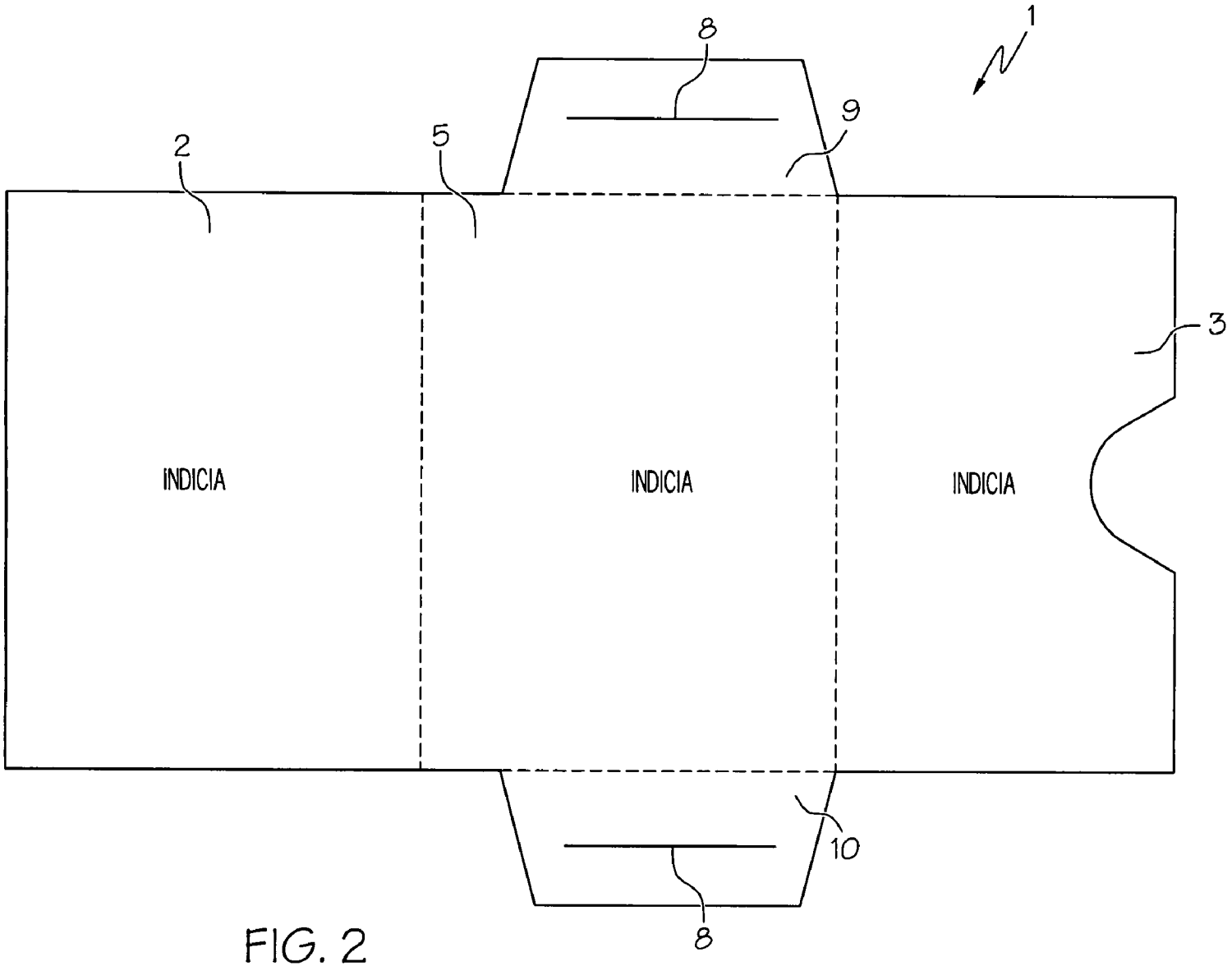
FIG. 2 is an exterior view of an unfolded cardholder blank used for forming a cardholder.
Figure 6:
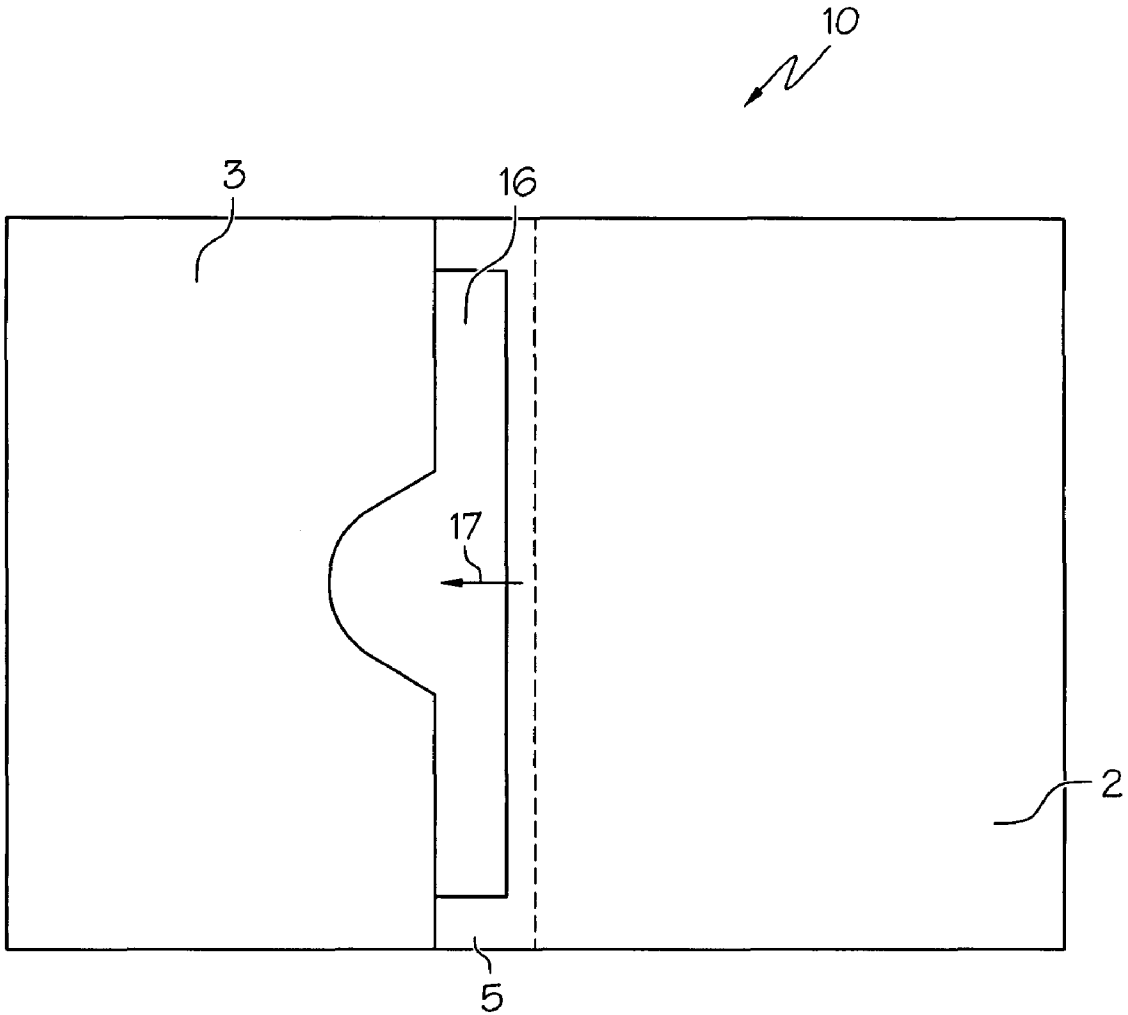
FIG. 6 in an interior view of a folded cardholder having a terms and conditions attached inside the envelope.

Turning to the Figures, FIG. 1 shows an interior view of a cardholder blank 1 in an unfolded arrangement. The exterior or opposing view of the unfolded cardholder blank 1 of FIG. 1 is shown in FIG. 2. The blank 1 can be used, glued and folded to form a cardholder 10, as shown in FIG. 6, for holding or retaining a card, such as a gift debit card that can be purchased at a shopping mall. For example, the cardholder 10 can hold a plastic card (debit card) the size of a credit card with enough room to accommodate extra sheets of paper all within a three-sided, self-enclosed envelope 18 with an attached front cover 2. The cardholder 10 is designed to be compact in size for ease of storage in, for example, a shirt pocket, wallet or purse. As described below, the cardholder 10 comprises an envelope 18 and a sheet 16 containing terms and conditions, preferably attached to an inside or interior surface of the envelope 18.

The cardholder 10 starts out in the form of a cardholder blank 1, as shown in FIGS. 1 and 2. In an unfolded arrangement, the blank 1 can measure approximately $5\frac{1}{2}$"×$7\frac{15}{16}$" flat. The blank 1 can be die cut on a blanking die cutter, for example on a Bobst blanking die. The blank 1 can be made of, for example, paper, cardboard, plastic, or any suitable material that can be folded and/or printed on. In one example, the blank 1 can be made of 0.01 solid bleach sulfate cardboard. The blank 1 can have various surface finishes, which can provide a shiny or glossy appearance. The blank 1 can have any suitable thickness that allows for folding, such as a thickness in the range of 0.008 to 0.024 thousands of an inch. The blank 1 can be printed with indicia, such as advertising and the like, on one or both sides, such as by using an offset printing press.

As shown in FIG. 1, the unfolded cardholder blank 1 comprises five portions or flaps (2, 3, 5, 9, 10), which are separated by dotted fold lines on the interior face of the blank 1. Although not required, the dotted fold lines easily show where the appropriate folds are to be made to form the cardholder 10. The dotted fold lines can be printed on the interior surface of the blank 1, or alternatively can be non-penetrating perforations that ease the folding operation.

The five portions or flaps (2, 3, 5, 9, 10) have an interior face and an exterior face, wherein FIG. 1 shows the interior face of each portion. As will be clear below, the interior face of flaps 3, 5, 9 and 10 form the inside surfaces of the envelope 18 of the cardholder 10. The center portion 5 is surrounded by adjacent flaps 2, 3, 9, 10, one adjacent flap on each side of center flap 5 (i.e. 4 sides). Flaps 9 and 10 are on opposing sides of flap 5, and flaps 2 and 3 are on opposing sides of flap 5. Flap 5 can have one or more strips of adhesive material used to attach the terms and conditions sheet 16. As shown, flap 5 has two adhesive strips 7 spaced apart. The adhesive strips 7 can be glue, such as hot melt permanent glue, for attaching the terms and conditions sheet 16 to an inside surface of the envelope 18.

Flap 2 forms the front cover 2 of the cardholder 10, where the interior face of flap 2 covers the envelope 18 opening. The interior face of flap 2 can have indicia printed on its surface. For example, indicia indicating card purchase date, card value, purchase dates using a card, purchase amounts, card balance, and the like can be located on flap 2. In one embodiment, the indicia on the interior face of flap 2 can be in the form of a table or chart. The indicia on flap 2 can allow the consumer to track purchases and keep track of remaining balance on the card, if pre-loaded with money. The interior face of flap 3 forms an inside surface of the envelope 18. As shown, flap 3 can have a thumb cutout 6 along an outer edge. The thumb cutout 6 is designed to let the consumer easily remove the card from the envelope 18. Flaps 9 and 10 are arranged on opposing sides of center flap 5 and form inside surfaces of the envelope 18 when folded inward. In a folded arrangement, flaps 9 and 10 are not visible to a user and thus flaps 9 and 10 preferably do not have printed indicia.

As noted above, FIG. 2 shows the opposing, exterior face of the cardholder blank 1. On the exterior face, flaps 2, 3 and 5 can have indicia printed on their surface. The exterior face of flap 2 forms the outer front cover 2 face of the cardholder 10. Advertising, logos, diagrams and other wording such as "To:" and "From:" can be printed on the front cover. In the folded arrangement, the front cover 2 can bend or rotate along the dotted fold line, located at the intersection of flaps 5 and 2. The exterior face of flap 5 forms the outer back face of the cardholder 10. Advertising and the like can be printed on the back cover. The exterior face of flaps 9 and 10 can have a strip 8 of adhesive material applied for securing or attaching the interior face of flap 3 when forming the envelope 18. The adhesive strip 8 can be glue, such as cold resin permanent glue or hot melt permanent glue.

Figure 3:
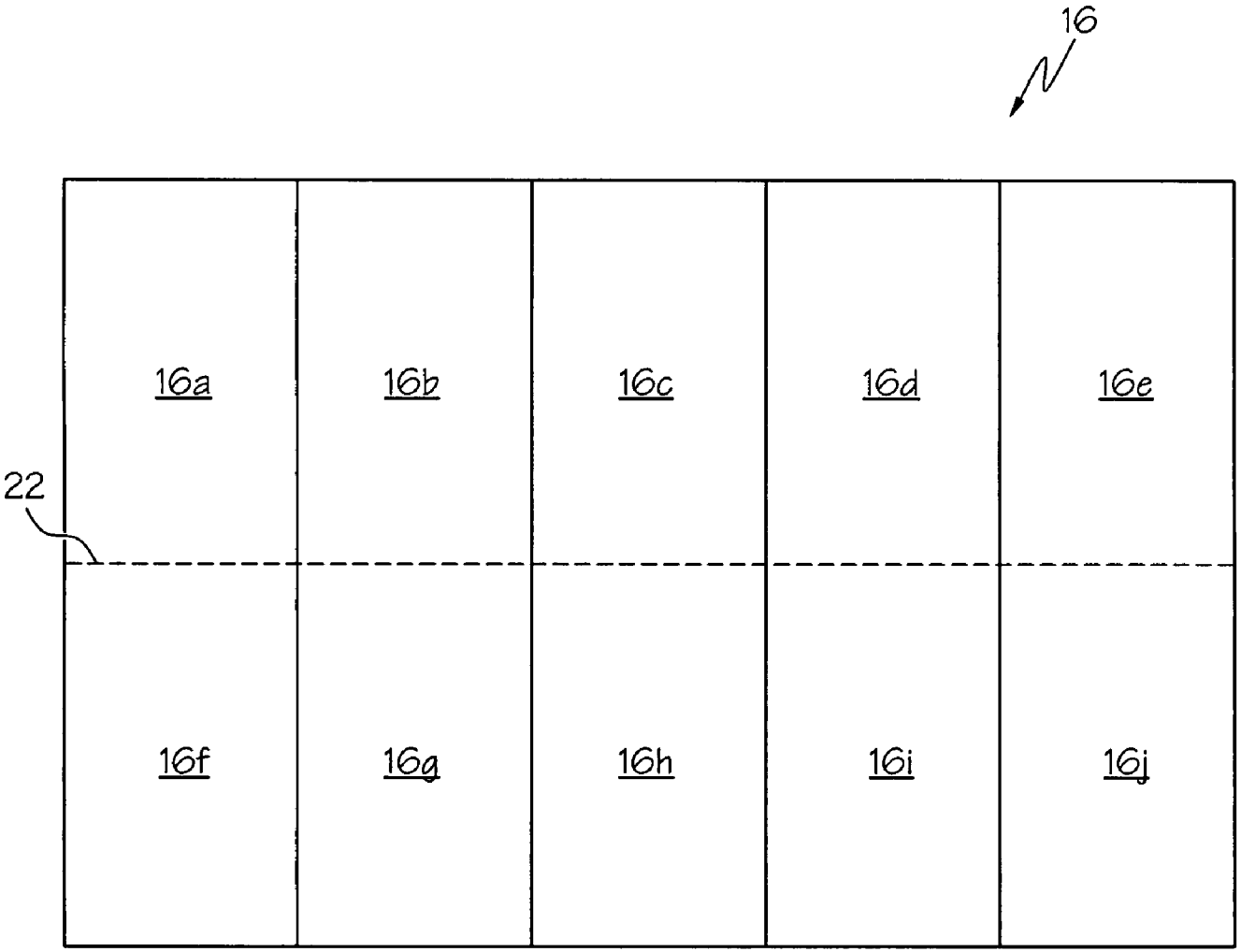
FIG. 3 is a front face view of an unfolded terms and conditions sheet.
Figure 4:
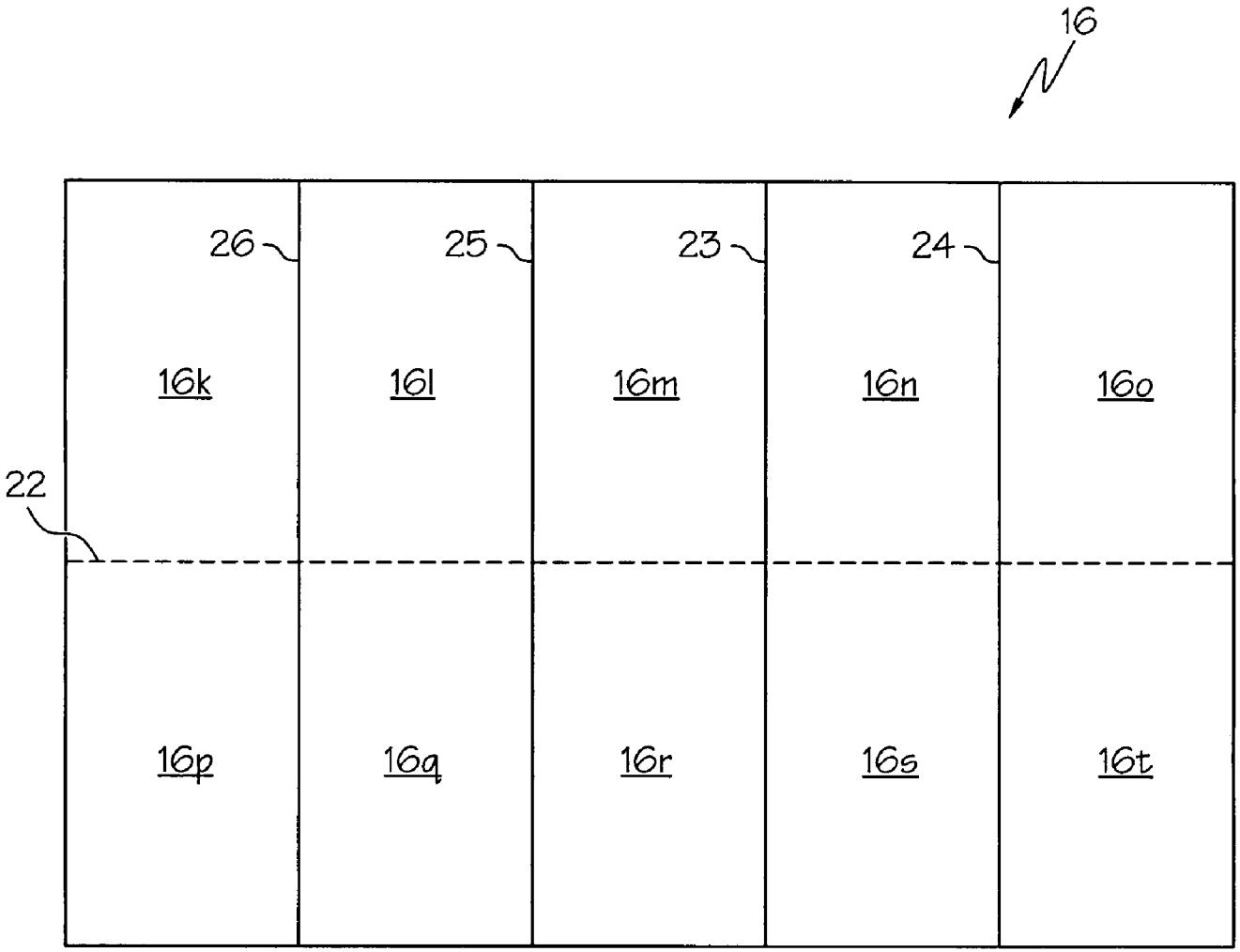
FIG. 4 is a back face view of an unfolded terms and conditions sheet.
Figure 5:
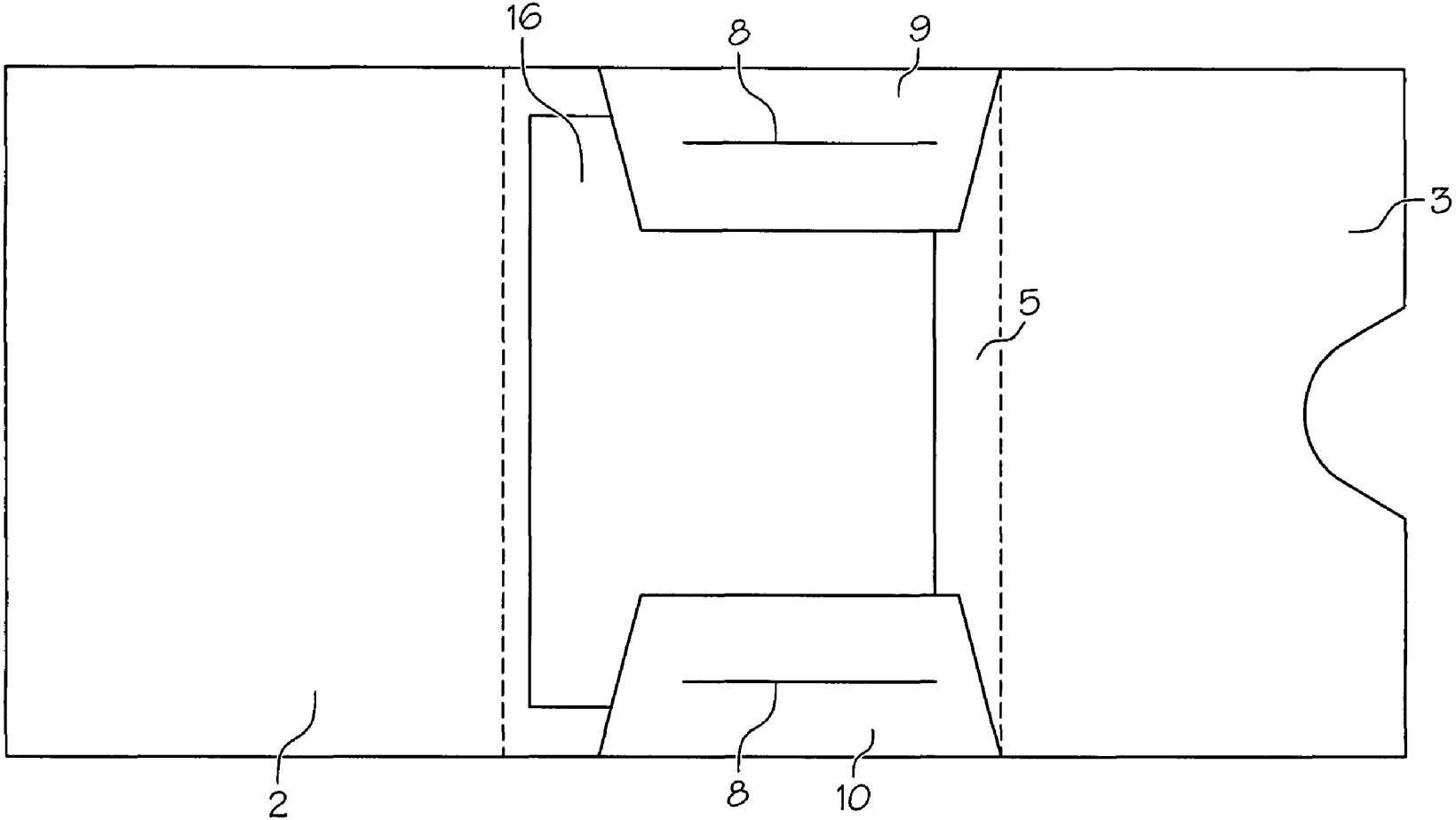
FIG. 5 is an interior view of a partially folded cardboard blank having an attached terms and conditions sheet.

Turning to FIGS. 3 and 4, the front face and back face of a terms and conditions sheet 16 is shown, respectively. The terms and conditions sheet 16 is shown in a 10-fold arrangement, although any other number of folds and/or panels can be used, such as a 12-fold arrangement, wherein the fold number equates to the number of panels a sheet 16 is divided into. The front face of the sheet 16 has ten panels, 16*a* through 16*j*, and the back face of the sheet 16 has ten panels, 16*k* through 16*t*. Although not shown, a 12-fold terms and conditions sheet could be folded in a similar manner as described below with respect to the 10-fold arrangement. The terms and conditions sheet 16 is preferably a single sheet having indicia printed on both sides, such as by using an offset printing press. Indicia can be printed on all of the panels of the sheet 16, or optionally on pre-selected panels to accommodate a desirable folding arrangement for attaching the sheet 16 to the cardholder 10 or envelope 18. The terms and conditions sheet 16 can be made of any suitable material that can be printed on. Preferably, the terms and conditions sheet 16 is made of paper, such as 50 lb. offset paper, printed with ink on the front and back faces. In an unfolded arrangement, the terms and conditions sheet 16 can measure approximately 6¾"×10½" or 6⅝"×12⅜." In the folded-up position, the terms and conditions sheet 16 can measure approximately 3⅜"×2⅛" (as shown in FIGS. 5 and 6). The terms and conditions sheet 16 can be folded by a machine as known in the art, such as on a Baum folder machine. The terms and conditions sheets 16 are preferably folded-up prior to folding of the blank 1 so the sheets 16 can be attached to the blank 1 easily before forming the cardholder envelope 18.

A folding method for a 10-fold terms and condition sheet 16 is described below. To fold the terms and conditions sheet 16, first fold the sheet 16 in half along fold line 22 so panel 16*a* contacts panel 16*f*. In this position, the front face of the terms and conditions sheet 16 is folded inward on its self such that the front face is not visible. The back face of the terms and conditions sheet 16, panels 16*k* through 16*t*, are visible, with panels 16*k* through 16*o* on one side and panels 16*p* through 16*t* on the opposing side. To continue folding, fold along fold line 23 such that panel 16*s* contacts panel 16*r*. Next, fold along fold line 24 so panel 16*o* contacts 16*n*, and then fold along fold line 25 such that panel 16*q* contacts panel 16*t*. To complete the folded-up terms and conditions sheet 16, fold along fold line 26 so panel 16*p* contacts 16*m*. The folded-up terms and conditions sheet 16 is compact and easy to attach to the cardholder 10.

In the complete folded arrangement, as shown in FIGS. 5 and 6, panel 16*k* can be attached to an inside surface of the envelope 18, for example to the interior face of flap 5. Panel 16*k* can be left blank with no indicia because it is not visible once attached to an inside surface of the envelope 18 or any other surface of the cardholder 10. On the reverse side of panel 16*k*, panel 16*e* is preferably also left blank in case the terms and conditions sheet 16 is ripped when removed from the cardholder 10, such as from an inside surface of the envelope 18. Once attached to an inside of the envelope 18, panel 16*l* faces forward and is visible to the viewer. If attached to the interior surface of flap 5, panel 16*l* faces the front portion of the envelope 18. Thus, indicia is preferably printed on panel 16*l* that indicates to the consumer that important information regarding the terms and conditions of the card is enclosed. The remaining panels of the terms and conditions sheet, panels 16*a* through 16*d*, panels 16*f* through 16*j*, and panels 16*m* through 16*t*, can have printed indicia that reflects the terms and conditions of the card residing in the envelope 18.

A folding method for forming the envelope 18 and cardholder 10 is described below. To form the cardholder 10, inclusive of the folded-up terms and conditions sheet 16, the blank 1 is folded such that an envelope 18 is created. Two adhesive strips 7 of hot melt permanent glue are applied to the interior face of center flap 5. The folded-up terms and conditions sheet 16 is pressed onto the strips 7 so that the folded terms and conditions sheet 16 is attached to an inside surface of the envelope 18. Next, flaps 9 and 10 are folded over as shown in FIG. 5, on top of the now-attached folded terms and conditions sheet 16. Next, adhesive strips 8 of cold resin glue are applied to the exterior surface of flaps 9 and 10, or alternatively to the interior surface of flap 3 (not shown). Flap 3 is folded over flaps 9 and 10 so the interior surface of flap 3 is attached to the exterior surfaces of flaps 9 and 10, as shown in FIG. 6, which forms the envelope 18 or 3-sided pocket for the card and folded-up terms and conditions sheet 16. The folded-up terms and conditions sheet 16 is conveniently already inserted for ease of distribution. In another arrangement, the folded-up terms and conditions sheet 16 can be attached to the interior face of flap 3 with adhesive strips and thus adhesive strips 7 on flap 5 would not be needed. Lastly, flap 2 is folded over the exterior surface of flap 3 to form the front cover 2 of the cardholder 10. The cardholder 10 can be folded or formed by a machine as is known in the art, such as a Bobst Model 100 Media gluer, with added components of two hot melt glue heads and Model 250 Multifeeder. The Model 250 Multifeeder is designed and adapted with the purpose of continuously feeding and inserting the folded terms and conditions sheet 16 into the envelope 18 before the final glue fold is made, which attaches flaps 9 and 10 to flap 3.

In another embodiment, the folded-up terms and conditions sheet 16 can be attached to an outside surface of the envelope 18. For example, the sheet 16 can be attached to the exterior surface of flap 3, which forms the front face of the envelope 18, as shown in FIG. 6. Adhesive strips, such as those shown on flap 5 of FIG. 1, can be used to secure the folded-up sheet 16 to an outside surface of the envelope 18. In this arrangement, the folded-up sheet 16 is permanently attached to the envelope 18.

As described above, the formed envelope 18 opens from the side such that the front cover is turned forward so a card can be inserted into the envelope 18. In an alternative configuration, the opening of the envelope 18 can be designed to open from the top or bottom, rather from the side, so the debit card can be inserted in the envelope 18 from the top or bottom. Although not shown, a thumb notch can be added to an edge of flap 2 such that it extends from the edge of flap 2 and is in register with a slot formed in flap 3. The thumb notch and slot arrangement allows the front cover 2 of the cardholder 10 to be secured so that is does not bend or flop open during use.

The cardholder 10, in the folded and glued arrangement as described above, can measure approximately 2¾"×3¾." In use, a card, such as a debit card that can be loaded with money, can be inserted into the envelope 18 of the cardholder 10, as indicated by arrow 17 in FIG. 6, on top of the folded-up sheet 16 located on an inside surface. In this arrangement, the card and sheet 16 reside in the envelope 18. Optionally, coupons and/or other advertising can be stuffed into the envelope 18 of the cardholder 10, or alternatively glued or otherwise attached, such as by paper perforations, to the outside or inside edges of the cardholder 10.

One advantage is that the terms and conditions sheet 16 is permanently attached to the cardholder 10 holding the debit card, or the envelope 18, so that the terms and conditions associated with the debit card will be legally binding on the customer, consumer or user. One other advantage of the cardholder 10 is that the folding arrangement of the terms and conditions sheet 16 allows a user to unfold and read the sheet 16, and then re-fold the sheet 16, without having to tear it from the cardholder 10 or envelope 18. Further, as a cardholder 10 is sold, a seller, such as a mall, can sell the debit card and insert the loaded debit card in the cardholder 10 quickly, easily and conveniently, without having to fold up the cardholder like a highway map, which reduces costs and time.

The cardholder 10 described herein is economical to produce and uses less material, such as paper and cardboard. For example, the cardholder 10 preferably does not include pages that can require additional paper and production time and costs. The cardholder 10 is easy to use, without having to unfold and re-fold sheets each time the debit card is removed and re-inserted into the envelope 18. Because the terms and conditions sheet 16 is already attached to the envelope 18, and usually before a debit card has been loaded with money, the invented cardholder 10 requires less time to distribute and/or attach the terms and conditions with distribution of the debit card at the point of sale.

It should now be apparent that there has been provided, in accordance with the present invention, a novel cardholder having a folded-up sheet 16 containing terms and conditions that is attached to an envelope adapted to receive and hold a gift debit card. Moreover, it will be apparent to those skilled in the art that many modifications, variations, substitutions, and equivalents for the features described above may be effected without departing from the spirit and scope of the invention as defined in the claims to be embraced thereby.

The preferred embodiments have been described, herein. It will be apparent to those skilled in the art that the above methods may incorporate changes and modifications without departing from the general scope of this invention. It is intended to include all such modifications and alterations in so far as they come within the scope of the appended claims or the equivalents thereof.

What is claimed is:

1. A cardholder comprising an envelope having a debit card positioned inside said envelope, said envelope having a folded sheet having indicia printed on at least one surface, said folded sheet being attached to an inside surface of said envelope, said indicia being a statement of the terms and conditions which control and govern the use of said debit card.

2. The cardholder of claim 1, said cardholder having approximate dimensions of 2¾" by 3¾" high.

3. The cardholder of claim 1, said envelope being formed from a single cardholder blank.

4. The cardholder of claim 3, said cardholder blank having dotted fold lines printed on one side.

5. The cardholder of claim 1, said folded sheet being physically attached to said inside surface of said envelope by hot melt permanent glue.

6. The cardholder of claim 1, said folded sheet being a single sheet having indicia printed on both sides.

7. The cardholder of claim 1, said folded sheet being folded up in a 10-fold arrangement.

8. The cardholder of claim 1, said folded sheet comprising a plurality of panels, wherein only one panel of said plurality of panels is attached to said inside surface of said envelope.

9. The cardholder of claim 1, said envelope being paper or cardboard.

10. A cardholder comprising an envelope having a debit card positioned inside said envelope, said envelope having an opening for receiving said debit card, a front cover forming a single flap that covers said opening of said envelope, and a folded sheet physically attached to said envelope, wherein said folded sheet is printed with indicia including the terms and conditions which control and govern the use of said debit card such that said terms and conditions are legally binding on the user of said debit card.

11. The cardholder of claim 10, said folded sheet comprising a plurality of panels, wherein only one panel of said plurality of panels is attached to said inside surface of said envelope such that a user of said debit card can unfold and read said folded sheet without having to tear it from said envelope.

12. The cardholder of claim 11, said folded sheet being physically attached to said inside surface of said envelope by hot melt permanent glue.

13. The cardholder of claim 10, said envelope being paper or cardboard.

* * * * *